US010668529B1

(12) United States Patent
Yurko et al.

(10) Patent No.: US 10,668,529 B1
(45) Date of Patent: Jun. 2, 2020

(54) SYSTEMS AND METHODS FOR PROCESSING BULK METALLIC GLASS ARTICLES USING NEAR NET SHAPE CASTING AND THERMOPLASTIC FORMING

(71) Applicant: Materion Corporation, Mayfield Heights, OH (US)

(72) Inventors: James A. Yurko, Saratoga, CA (US); Nicholas W. Hutchinson, Toledo, OH (US)

(73) Assignee: Materion Corporation, Mayfield Heights, OH (US)

( * ) Notice: Subject to any disclaimer, the term of this patent is extended or adjusted under 35 U.S.C. 154(b) by 987 days.

(21) Appl. No.: 14/970,239

(22) Filed: Dec. 15, 2015

Related U.S. Application Data

(60) Provisional application No. 62/092,660, filed on Dec. 16, 2014.

(51) Int. Cl.

| | |
|---|---|
| ***B22D 27/11*** | (2006.01) |
| ***B22D 29/00*** | (2006.01) |
| ***B22D 30/00*** | (2006.01) |
| ***B22D 27/04*** | (2006.01) |
| ***B22D 21/00*** | (2006.01) |

(52) U.S. Cl.
CPC ..... *B22D 27/11* (2013.01); *B22D 21/00* (2013.01); *B22D 27/04* (2013.01); *B22D 29/00* (2013.01); *B22D 30/00* (2013.01)

(58) Field of Classification Search
CPC ..... B22D 18/06; B22D 27/11; B22D 27/04
USPC ..... 148/538
See application file for complete search history.

(56) References Cited

U.S. PATENT DOCUMENTS

| | | | |
|---|---|---|---|
| 5,032,196 | A | 7/1991 | Masumoto et al. |
| 5,711,363 | A | 1/1998 | Scruggs et al. |
| 5,735,975 | A | 4/1998 | Lin et al. |
| 5,740,854 | A | 4/1998 | Inoue et al. |
| 5,758,712 | A | 6/1998 | Pedersen |
| 5,797,443 | A | 8/1998 | Lin et al. |
| 5,896,642 | A | 4/1999 | Peker et al. |
| 5,948,352 | A | 9/1999 | Vender Jagt et al. |
| 5,950,704 | A | 9/1999 | Johnson et al. |
| 6,021,840 | A | 2/2000 | Colvin |
| 6,044,893 | A | 4/2000 | Taniguchi et al. |

(Continued)

FOREIGN PATENT DOCUMENTS

| | | | |
|---|---|---|---|
| WO | 2011159596 | A1 | 12/2011 |
| WO | 2013039513 | A1 | 3/2013 |

(Continued)

*Primary Examiner* — Weiping Zhu
(74) *Attorney, Agent, or Firm* — Jones Day

(57) ABSTRACT

Methods and systems for casting and thermoplastically forming bulk metallic glass articles are described. A molten alloy can be fed into a mold with a three-dimensional shape and a cavity. The mold is configured such that multiple two-dimensional cross sections of the cavity of the mold are different from one another in multiple first mathematical planes intersecting the cavity displaced from one another in a direction normal to the mathematical planes intersecting the cavity. Cooling the molten alloy in the mold provides one or more near net shape bulk metallic glass castings, can be thermoplastically formed using forms at a temperature above Tg to provide a bulk metallic glass article with a desired final shape.

11 Claims, 6 Drawing Sheets

(56) References Cited

U.S. PATENT DOCUMENTS 6,189,600 B1 2/2001 Taniguchi et al.
6,231,697 B1 5/2001 Inoue et al.
6,267,170 B1 7/2001 Onuki et al.
6,306,228 B1 10/2001 Inoue et al.
6,371,195 B1 4/2002 Onuki et al.
6,453,984 B1 9/2002 Liebermann et al.
6,499,529 B1 12/2002 Farkas
6,508,296 B2 1/2003 Yamaguchi et al.
6,521,058 B1 2/2003 Inoue et al.
6,581,673 B1 6/2003 McKibben et al.
6,592,689 B2 7/2003 Hays
6,620,264 B2 9/2003 Kundig et al.
6,627,146 B1 9/2003 McKibben et al.
6,637,496 B1 10/2003 Macheske et al.
6,637,497 B2 10/2003 Herron
6,652,679 B1 11/2003 Inoue et al.
6,655,446 B2 12/2003 Liebermann et al.
6,666,254 B2 12/2003 Voigt et al.
6,684,934 B1 2/2004 Cargill et al.
6,692,590 B2 2/2004 Xing et al.
6,763,879 B1 7/2004 Macheske et al.
6,766,850 B2 7/2004 Gegel et al.
6,779,588 B1 8/2004 Good et al.
6,805,758 B2 10/2004 Wolter
6,875,293 B2 4/2005 Peker
6,889,745 B2 5/2005 Redemske
6,896,750 B2 5/2005 Wolter
6,918,973 B2 7/2005 Hufnagel et al.
7,011,718 B2 3/2006 Decristofaro et al.
7,017,645 B2 3/2006 Johnson et al.
7,070,665 B2 7/2006 Hays
7,153,376 B2 12/2006 Wolter
7,246,649 B2 7/2007 Muramatsu et al.
7,293,599 B2 11/2007 Peker et al.
7,296,612 B2 11/2007 Bend
7,300,529 B2 11/2007 Kuehn et al.
7,368,023 B2 5/2008 Chang et al.
7,506,566 B2 3/2009 Decristofaro et al.
7,591,910 B2 9/2009 Xu et al.
7,614,440 B2 11/2009 Muramatsu et al.
7,708,844 B2 5/2010 Muramatsu et al.
8,034,200 B2 10/2011 Fleury et al.
8,079,401 B2 12/2011 Sundarraj et al.
8,186,417 B2 5/2012 Ribeiro
8,221,561 B2 7/2012 Gong et al.
8,303,890 B2 11/2012 Grassi et al.
8,308,877 B2 11/2012 Gong et al.
8,312,913 B2 11/2012 Gervasi et al.
8,333,230 B2 12/2012 Marsden et al.
8,333,850 B2 12/2012 Gong et al.
9,802,247 B1 * 10/2017 Yurko ..... B22D 18/06
2005/0121165 A1 6/2005 White
2006/0037361 A1 * 2/2006 Johnson ..... A44C 27/002 63/37
2006/0157217 A1 7/2006 Bassi
2007/0000635 A1 1/2007 Bend
2008/0190521 A1 8/2008 Loffler et al.
2008/0257519 A1 10/2008 Carrig et al.
2008/0295991 A1 12/2008 Roth et al.
2009/0139612 A1 6/2009 Lu et al.
2009/0202386 A1 8/2009 Yi et al.
2009/0236017 A1 9/2009 Johnson et al.
2009/0321037 A1 12/2009 Lewis et al.
2011/0079940 A1 4/2011 Schroers et al.
2011/0097237 A1 4/2011 Gong et al.
2011/0100514 A1 5/2011 Liu et al.
2011/0155288 A1 6/2011 Ming
2011/0163509 A1 7/2011 Pham et al.
2011/0272064 A1 11/2011 Peker et al.
2011/0308671 A1 12/2011 Gong et al.
2012/0006085 A1 1/2012 Johnson et al.
2012/0073706 A1 3/2012 Gong et al.
2012/0103478 A1 5/2012 Johnson et al.
2012/0125071 A1 5/2012 Schroers et al.
2012/0132625 A1 5/2012 Kaltenboeck et al.
2012/0152412 A1 6/2012 Opie et al.
2012/0222785 A1 9/2012 Li et al.
2012/0288728 A1 11/2012 Hofmann et al.
2012/0298264 A1 11/2012 Yi et al.
2012/0298266 A1 11/2012 Johnson et al.
2012/0305142 A1 12/2012 Jaworski et al.
2012/0312061 A1 12/2012 Pham et al.
2013/0000862 A1 1/2013 Cretegny et al.
2013/0001222 A1 1/2013 Kaltenboeck et al.
2013/0037232 A1 2/2013 Pham et al.

FOREIGN PATENT DOCUMENTS

WO 2013043149 A1 3/2013
WO 2013048429 A1 4/2013
WO 2013055365 A1 4/2013

* cited by examiner

110 - Cast near net BMG shape article from molten alloy at sufficient cooling rate 120 – Remove near net shape BMG castings from molds 130 - Thermoplastically form BMG article using forms to impress structural features at elevated temperature, e.g., T > Tg FIG. 1C
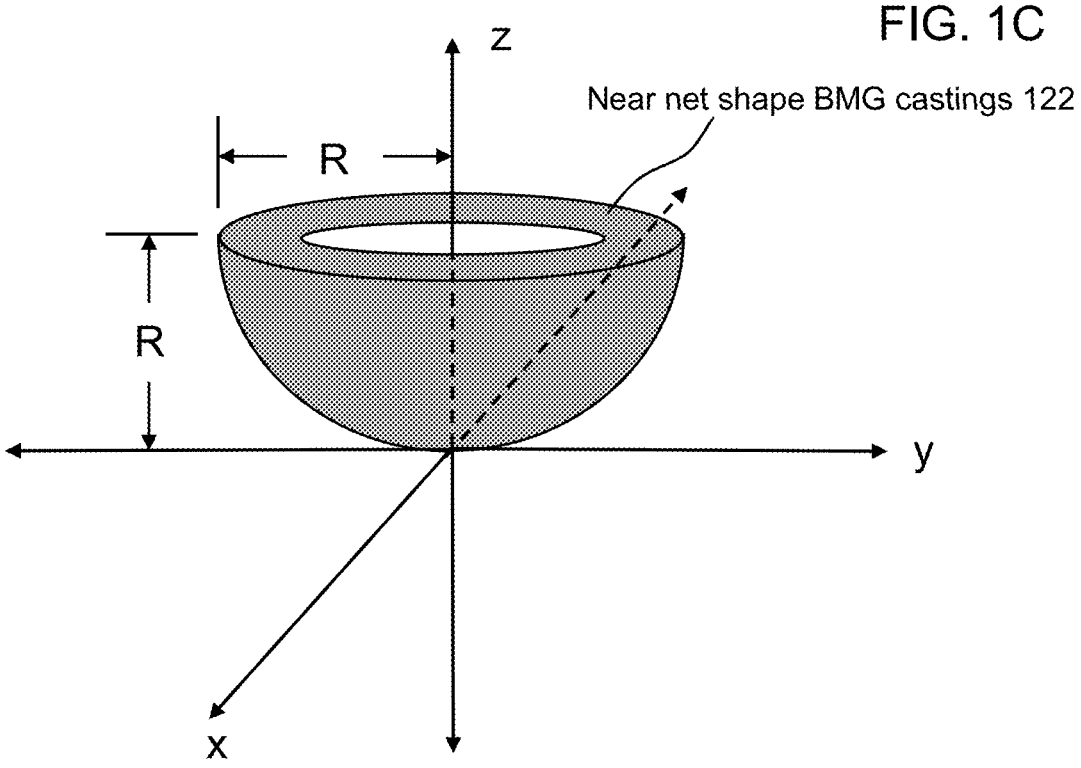
2-D cross sections of casting 122 in planes parallel to y-z plane at various values of x in the x direction
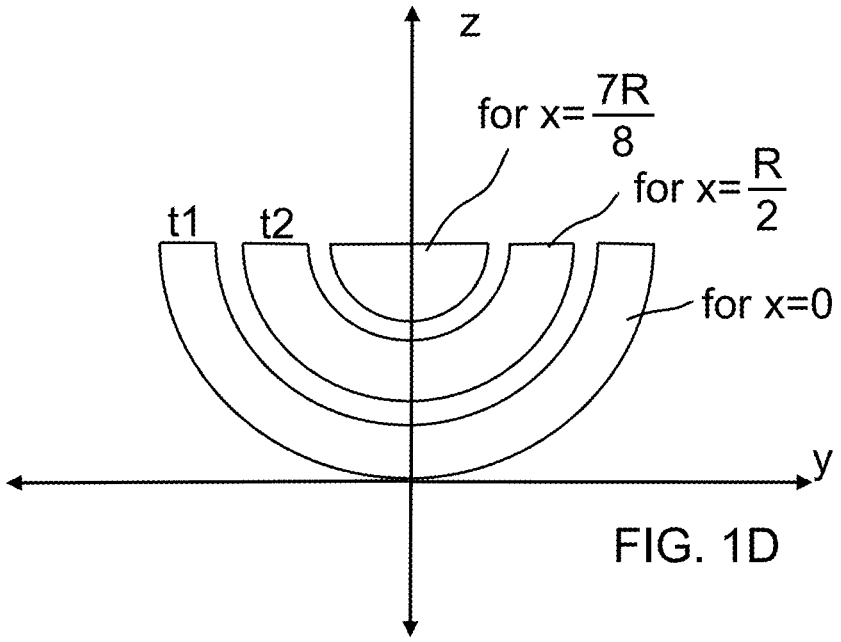
FIG. 1D 2-D cross sections of casting 122 in planes parallel to x-z plane at various values of y in the y direction 2-D cross sections of casting 122 in planes parallel to x-y plane at various values of z in the z direction

300

SYSTEMS AND METHODS FOR PROCESSING BULK METALLIC GLASS ARTICLES USING NEAR NET SHAPE CASTING AND THERMOPLASTIC FORMING

This application claims the benefit of U.S. Provisional Patent Application No. 62/092,660 filed Dec. 16, 2014, the entire contents of which are incorporated herein by reference.

BACKGROUND

Field of the Disclosure

The present disclosure relates to metallic alloys, and more particularly to the formation of articles of bulk amorphous metal alloys.

Background Information

Bulk metallic glass (BMG) alloys are a family of materials that, when cooled at rates generally less than 100° C./s, form an amorphous (or non-crystalline) microstructure with thicknesses in the range of 0.1 to 10 mm or greater. BMGs may have unique and novel properties given their lack of long-range order and absence of crystalline structure. BMG alloys may have exceptional strength, high elasticity, limited plasticity, good corrosion and wear resistance, and high hardness relative to their crystalline counterparts, and are non-magnetic. From a processing perspective, the alloys also offer unique possibilities. BMG alloys may have melting temperatures far below their constituent elements, allowing for permanent mold casting processes and other processing such as thermoplastic forming, which are not possible with many conventional alloy systems. One common BMG alloy is VITRELOY® 1b, a Zr-based BMG alloy having a composition (atomic) of $Zr_{44}Ti_{11}Cu_{10}Ni_{10}Be_{25}$, which has a melting temperature of less than 1000 C and a glass transition temperature Tg of about 350 C.

Because of their amorphous structure, BMG alloys can be processed by thermoplastic forming. However, the present inventors have observed that challenges exist with conventional thermoplastic forming of BMG articles and that there remains a need for improved approaches of preparing BMG articles using thermoplastic forming. Exemplary approaches described herein may address such needs.

SUMMARY

Exemplary systems and approaches are described for processing bulk metallic glass (BMG) articles using near net shape casting and thermoplastic forming. Accordingly to one example, a method for casting and thermoplastically forming a bulk metallic glass article comprises: feeding a molten alloy into a mold, wherein the mold comprises a cavity with a three-dimensional shape for making a casting from the molten alloy, the mold being configured such that multiple two-dimensional cross sections of the cavity of the mold are different from one another in multiple first mathematical planes intersecting the cavity displaced from one another in a first direction normal to the mathematical planes intersecting the cavity, cooling the molten alloy in the mold to provide a near net shape bulk metallic glass casting in the mold; removing the bulk metallic glass casting from the mold, wherein multiple two-dimensional cross sections of the bulk metallic glass casting are different from one another in multiple mathematical planes intersecting the casting displaced from one another in a given direction normal to the mathematical planes intersecting the casting; placing the casting in proximity to forms for thermoplastically forming the casting; thermoplastically forming the casting at an elevated temperature above a glass transition temperature of the bulk metallic glass casting to provide a bulk metallic glass article with a desired final shape; and removing the bulk metallic glass article from the forms.

According to another example, a method for casting and thermoplastically forming a bulk metallic glass article comprises: feeding a molten alloy into a mold, wherein the mold comprises a cavity with a three dimensional shape for making a casting from the molten alloy, wherein the three dimensional shape of the cavity does not have a substantially uniform cross section in multiple mathematical planes displaced from one another in a first direction; cooling the molten alloy in the mold to provide a near net shape bulk metallic glass casting in the mold, wherein the bulk metallic glass casting is not in the shape of a solid sheet, solid bar or solid cylinder that have substantially uniform two-dimensional cross sections; removing the bulk metallic glass casting from the mold; placing the casting in proximity to forms for thermoplastically forming the casting; thermoplastically forming the casting at an elevated temperature above a glass transition temperature of the bulk metallic glass casting to provide a bulk metallic glass article with a desired final shape; and removing the bulk metallic glass article from the forms.

BRIEF DESCRIPTION OF THE FIGURES

These and other features, aspects, and advantages of the present disclosure will become better understood with regard to the following description, appended claims, and accompanying drawings.

Figure 1A:
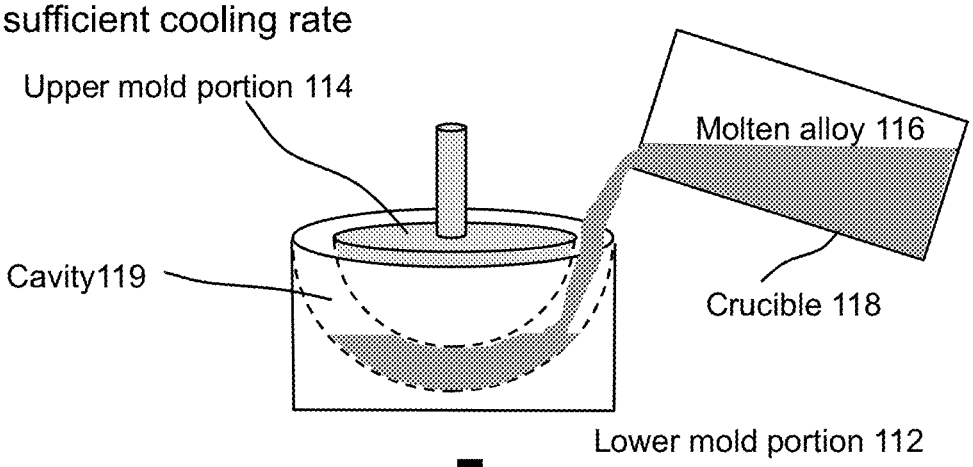
FIG. 1A illustrates an overview of an exemplary approach for casting a near net shape BMG casting and thermoplastically forming the casting into a final BMG article of desired shape.
Figure 1A:
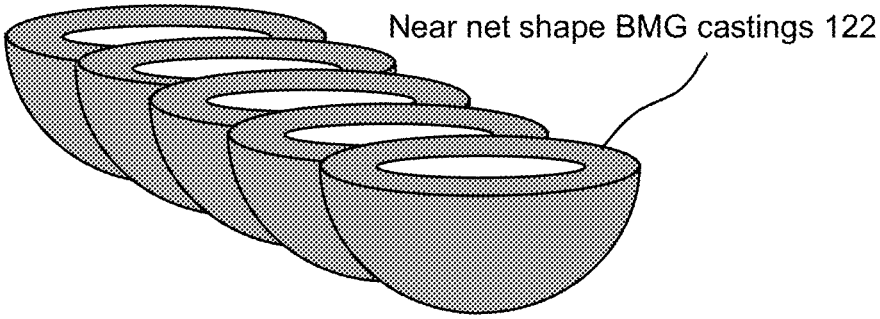
Figure 1A:
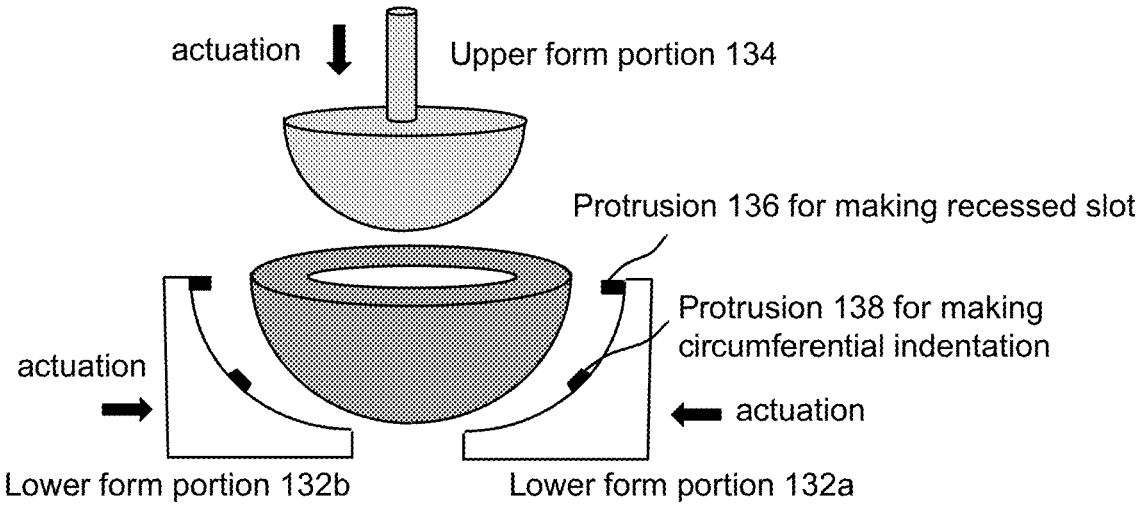

FIG. illustrates two-dimensional cross sections of the BMG casting of the example of FIG. 1A in planes parallel to x-z plane at various values of y in the y direction.

Figure 1B:
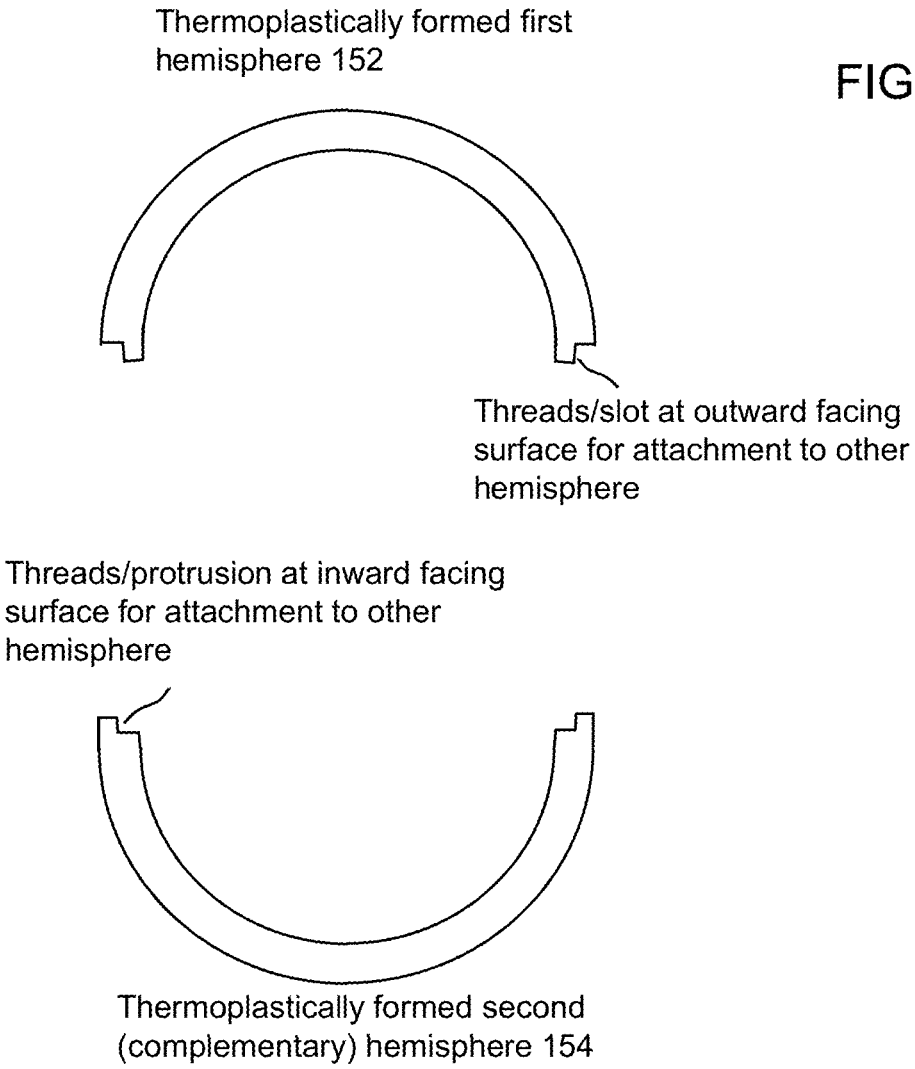
FIG. 1B illustrates in cross section an exemplary BMG article formed by the approach of FIG. 1A.
Figure 1E:
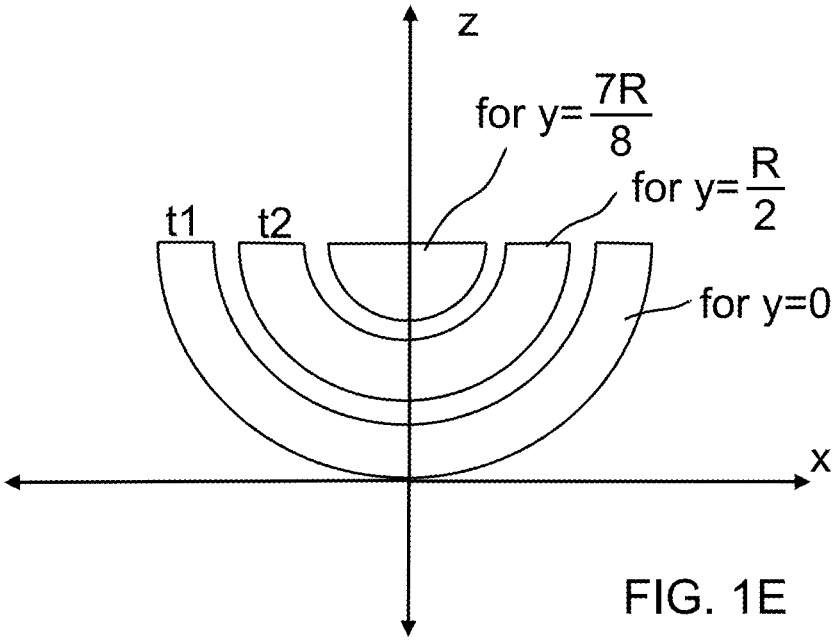
FIG. 1C illustrates an exemplary near net shape BMG casting of the example of FIG. 1A shown on a three-dimension coordinate system.
FIG. 1D illustrates two-dimensional cross sections of the BMG casting of the example of FIG. 1A in planes parallel to y-z plane at various values of x in the x direction.
Figure 1F:
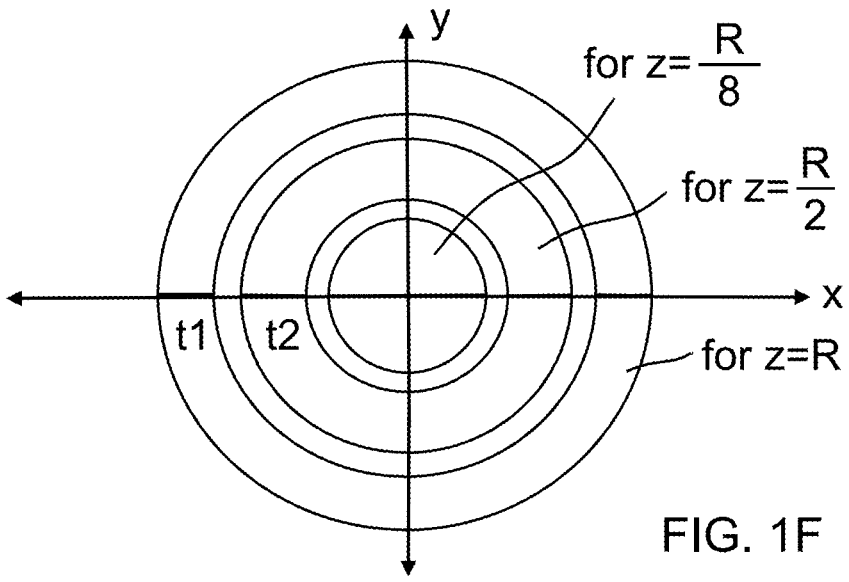

FIG. 1F illustrates two-dimensional cross sections of the BMG casting of the example of FIG. 1A in planes parallel to x-y plane at various values of z in the z direction.

Figure 2:
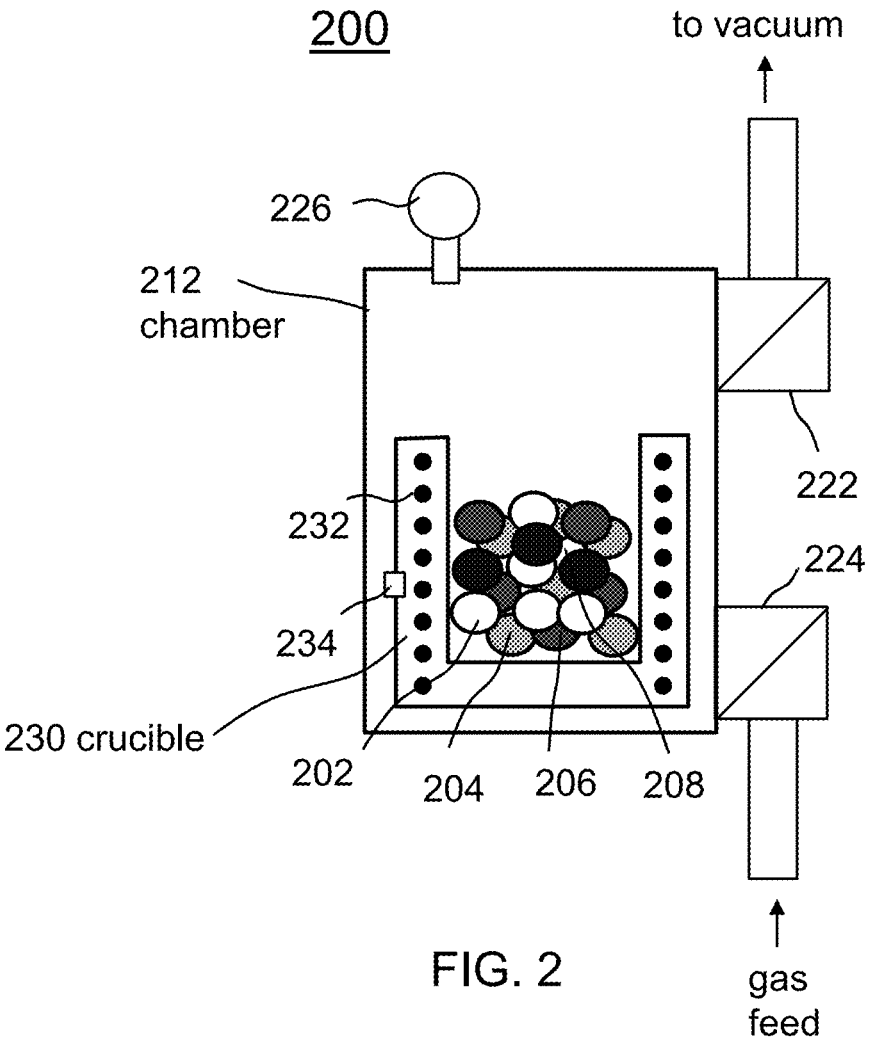

FIG. 2 illustrates an exemplary apparatus and approach for preparing a metallic alloy such as a BMG.

Figure 3:
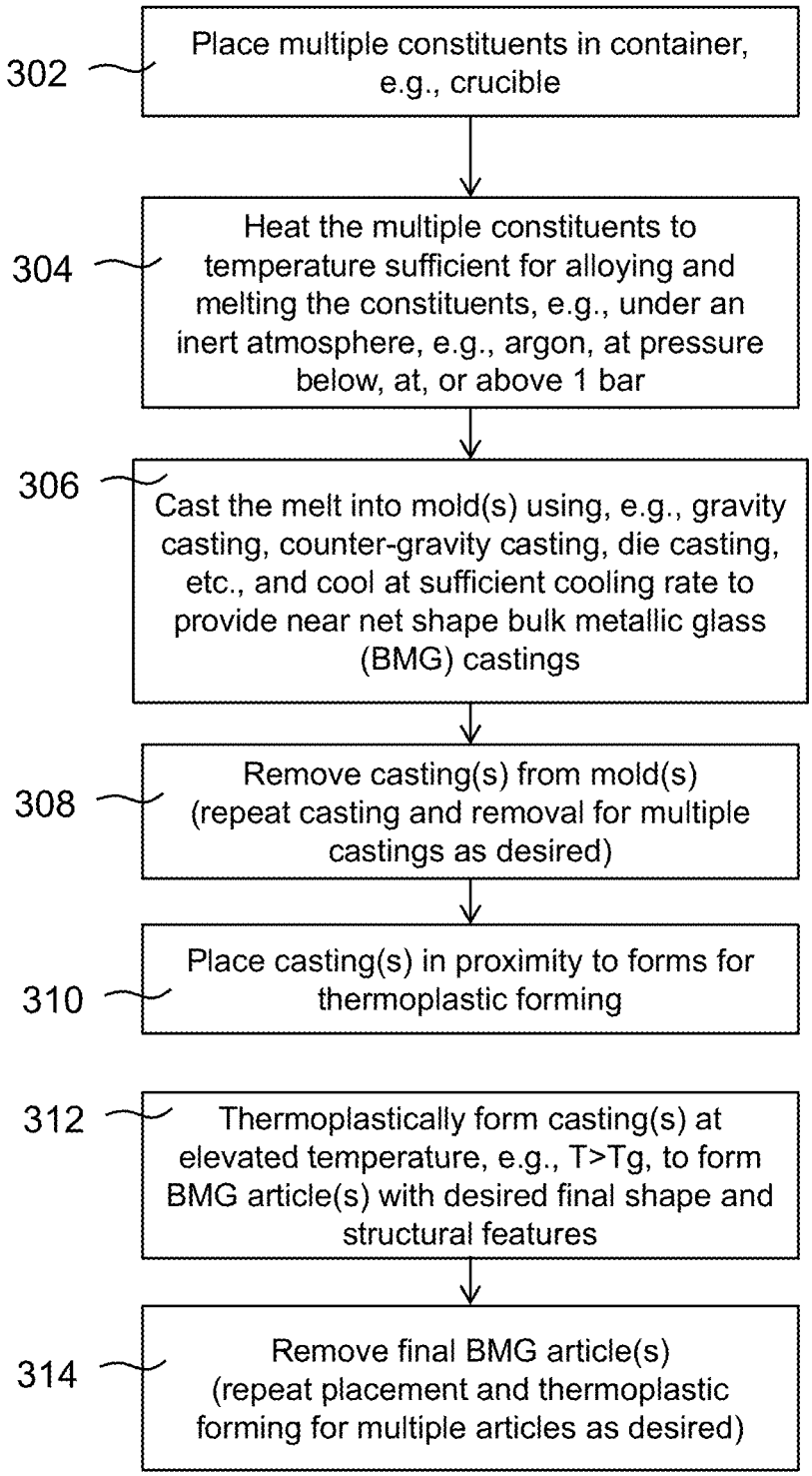

FIG. 3 illustrates a flow diagram of an exemplary approach for casting a near net shape BMG casting and thermoplastically forming the casting into a final BMG article of desired shape.

DETAILED DESCRIPTION OF EXEMPLARY EMBODIMENTS

BMG alloys may contain combinations of three or more different elements, and some of the best BMG alloy forming systems contain four or five or more elements. Often, the elements are quite different from one another (early or late transition metal, metalloid, etc.) and form deep eutectic systems. This suggests that the thermodynamically disparate elements are more stable as a molten solution than in a solid-state. It is believed that the elements in such molten solutions encounter difficulty arranging into a crystal structure during solidification, and this allows the alloy to remain as an undercooled liquid and eventually a metallic glass. The best glass forming alloys generally have the slowest critical cooling rates, and this allows for a wider processing window for robust processing and production.

Because of the amorphous structure, BMG alloy as described herein can be processed in useful ways. BMG alloys typically have much lower melting temperatures than their base alloy constituent elements, thus the alloys can be cast with high volume processes such as die casting. For example, VITRELOY 1b has a melting temperature less than 1000 C, while Zr melts above 1800 C. Also, BMG alloys can be thermoplastically formed when in the amorphous state at temperatures above their glass transition temperature (Tg). Tg for VITRELOY 1b is about 350 C. This can allow for application of processing methods such as blow molding, warm extrusion, and compression molding.

Several processes may be utilized in the approaches described herein for fabricating BMG components. One such process is die casting (also called injection molding). In this process, the molten BMG alloy is heated to temperatures above the alloying melting temperature, and injected into a metal mold to form a net shape part. The process is inexpensive, but the many BMG alloys are formed from reactive metals, thus the die casting equipment can be quite expensive and specialized to operate in a vacuum or under an inert cover gas such as Ar. Although the process operating costs are relatively inexpensive, initial mold costs are expensive and limit the ability to make limited number of components which can be ideal for prototyping purposes. Molds are generally held closed during the casting (injection) process at forces ranging from 10 to 5000 tons; this applied force counteracts any hydrostatic force on the injected metal during injection. Molten temperatures of many BMG alloys are such that the permanent metal mold is exposed to high temperatures, and this can cause failure or degradation of the molds. The process also relies on injection speeds that can cause turbulence in the BMG alloy during filling of the mold which can cause casting defects. A benefit to die casting is that the starting alloy does not need to be in the amorphous state prior to melting and casting. The amorphous state is achieved by the high cooling rates experienced during injection into the mold. Examples of mold materials for the casting of BMG include, for instance, tool steels, Cu—Be alloys, Cu alloys and other materials with an acceptable combination of wear resistance and thermal conductivity.

Other fabrication process applicable to the approaches described herein are gravity casting or counter gravity casting into permanent molds. These techniques are similar to die casting, but rely upon either gravity or counter-gravity forces to fill a permanent mold at slower speeds than die casting. Cooling rates are still quite high, like die casting, necessary to achieve the amorphous state for the alloy, but because filling rates are quite slow, parts are limited to thicker walled parts with less ability to form net-shape features for complex parts. Gravity or counter gravity cast molds are generally much less expensive than die casting molds because the molds are not held shut with the large forces necessary for die casting.

Another process applicable to the approaches described herein is thermoplastic forming (TPF), which involves processing of a starting BMG alloy that has been cooled at sufficient rates to achieve the amorphous microstructure. Processing temperatures are cool enough that molds and tooling are well below their max operating temperatures (generally less than 500 C). Viscosity of the heated amorphous material is so high that turbulent flow is eliminated. Reaction of the metal with oxygen and carbon is reduced at these low temperatures, so non-vacuum or inert processing is permitted. Conventionally, the starting input material for thermoplastic forming is generally a plate or cylinder shape of BMG alloy. The present inventor has observed that this starting shape limits thermoplastic forming geometries that can be made. In particular, the present inventor has observed that some three dimensional shapes cannot effectively be made from conventional BMG plate because certain thermoplastic forming would require too much redistribution of BMG material in the form of buckling or folding, leading to unsatisfactory results or overly long processing times that may not be viable. This excessive shearing of the amorphous alloy can also increase the probability of recrystallizing the alloy. To the extent that TPF processing is carried out in non-vacuum or inert atmospheres, a superficial discoloration may be observed on the surface of the processed part that is easily removed and is not detrimental to the performance of the part.

FIG. 1A schematically illustrates an overview of an exemplary approach for forming BMG articles of desired shapes by casting (110) near net shape BMG castings (also called blanks) and subsequently thermoplastically forming the BMG castings into final BMG articles of desired, final shapes. As shown in FIG. 1A, a molten alloy 116 of a desired composition for a BMG article is introduced into molds, e.g., from a crucible 118, each of the molds comprising a first (e.g., lower) mold portion 112 and a second (e.g., upper) mold portion 114. While only one mold is illustrated in FIG. 1A, it will be appreciated that many such molds could be utilized, e.g., with a movable support such as a movable platform (e.g., rotating table, linear actuating table, conveyer belt, etc.) to accommodate high throughput manufacturing. Also, while an example of gravity casting into a permanent mold is shown in the example of FIG. 1A, counter gravity casting or die casting could also be used. The upper mold portion can be supported with support members, e.g., on actuators, so that a cavity 119 is formed. The cavity 119 defines the shape of the casting that will be formed from the molten alloy. The mold can be formed from various alloys and may be cooled, e.g., water cooled. The thermal properties of the mold, including the degree of cooling, may be chosen so that the cooling of the melt occurs at a sufficiently fast rate to form the BMG structure directly as the melt is cooled. That is, the molten alloy is directly cooled such that it solidifies with an amorphous structure.

After the casting 110 has been carried out, the near net shape BMG castings are removed (120) from the molds. This processing results in multiple BMG castings 122. Gravity casting can be performed in the same melting step as the melting of the desired BMG alloy; this combination of processes eliminates the need for a 1) alloying melting and casting step, followed by 2) a die casting or gravity casting process.

The near net shape BMG castings 122 are then thermoplastically formed (130) using multiple forming members or forms, which in the example of FIG. 1A are shown as a first (e.g., upper) form portion 134, a second (e.g., lower) form portion 132*a*, and a third (e.g., lower) form portion 132*b*. These positions of these forms 132*a*, 132*b*, 134 may be governed by support members and actuators so as to control the position, movement and amount of force applied to the forms. In this example, the forms may include protrusions 136 and 138 that permit the formation of recessed slots and circumferential slots or indentations at an outer surface of the BMG article to be thermoplastically formed and/or may include recesses that can permit the formation of ribs at an outer surface of the BMG article. Of course, structural features of a slot and rib are merely exemplary, and any desired features of greater complexity, e.g., threads, connecting portions, apertures, other recesses or protrusions, etc., may be formed consistent with the shape of the forming members being used. To thermoplastically form the BMG article as shown at 130 in FIG. 1A, the BMG casting can be heated to a temperature above the glass transition temperature Tg but below the crystallization temperature Tx of the BMG alloy (e.g., using a furnace, induction heating, resistive heating, joule heating, etc., and the forms 132*a*, 132*b*, and 134 may be actuated so as to expert pressure of the near net shape BMG casting to thermoplastically adjust the shape of the BMG near net shape casting into the desired final shape, e.g., so as to possess additional structural features not present in the near net shape BMG casting or to provide a final article with a more exact, refined shape. In examples, the overall envelope of the final shape of the thermoplastically formed article may be substantially similar to the near net shape of the casting 122 to within predetermined tolerances, such as, e.g., within 5 mm, within 4 mm, within 3 mm, within 2 mm, within 1 mm, or within 0.5 mm, for example, aside from any additional structural features imparted through the thermoplastic forming which may deviate from that envelope such that the displacement of amorphous alloy material for such features might exceed the tolerances listed above (e.g., an upper edge of an article might be thermoplastically folded over and formed into a lip whose periphery extends, e.g., 10 mm beyond the original envelop of the initial casting in that region for a large article). Examples of additional structural features could include, for instance, ribs, e.g., for increasing structural integrity and strength, other protrusions, indentations, features (such as indentations) to create stress risers in the material to promote or control where the casting may fracture and or controlling the final fracture particle size, e.g., such as a circumferential indentation or slot created by protrusion 138 shown in FIG. 1A, imprinted features of logos, decorative features, identification features on length scales that vary between nanoscale and macroscopic (visible to the human eye) to name a few. Temperature control can be important, as the amorphous alloy may only remain above the Tg for a finite amount of time before recrystallization occurs. The higher the temperature, the lower the viscosity and the easier to process, but recrystallization will occur within a shorter time frame. One or more of forms 132*a*, 132*b* and 134 may be retracted as applicable, and the thermoplastically formed BMG article may then be removed from the forms. It will be appreciated that whereas only one set for forms for thermoplastically forming one BMG article is shown in FIG. 1A, may forms for thermoplastically forming many articles may be utilized at the same time for high throughput manufacturing. It will be appreciated that multiple molds, 112, 114 may be utilized simultaneously and multiple forms 132*a*, 132*b*, 134 may be used simultaneously in a production setting, and that processing using such may be repeated over and over, to provide high throughput processing. Moreover, multiple molds of different cavity shapes may be used at the same time, and multiple forms of different shape may be used at the same time.

FIG. 1B illustrates an example of a BMG article formed by near net shape casting and subsequent thermoplastic forming such as described above. In this example, a pair of near net shape BMG hemispherical shell castings 122 are thermoplastically formed into two complementary hemispherical shells that can be mechanically attached together to form a hollow BMG hemispherical article. In this example, the casting 122 has a hollow portion, and more complicated castings made by approaches described herein may likewise have hollow portions. As shown in FIG. 1B, a first thermoplastically formed BMG hemisphere 152 may have a lip with an threads or slot(s) at an outward facing surface (for attachment to another complementary hemisphere). Likewise, a second thermoplastically formed second hemisphere 154, which is complementary to the hemisphere 152, may be formed with a complementary lip having threads or protrusion(s) at an inward facing surface thereof to mate in complementary fashion to the threads or slot(s) of the first hemisphere 152. Thus, in this example, the two hemispherical shells may be brought into contact with each other at the respective connecting portions and rotated such that the two haves thread together or such that protrusions for one hemisphere are secured into slots on the other hemisphere so as to connect the two halves together. In the discussion of the mating surfaces, the shape and design of the mating surfaces can be TPF formed to facilitate how the halves are joined. In addition to the connection example of threads and example of slots (or grooves) and mating lips described above, other means of attachment can be used for articles fabricated by the approaches described herein, such as features for a snap fit between connecting portions. In other examples, articles (or portions of articles) may be connected, joined or attached using hermetic seals, welded joints, inclusion of metal or polymer seal materials, and altering the surface roughness to facilitate joining technologies such as friction type welding (e.g., using friction, friction stir, inertial friction, ultrasonic energy, etc.) and fusion welding e.g., using (electron beams, lasers, etc) with or without filler material. In the example of FIGS. 1A and 1B, it will be appreciated that semi-spherical components with high mechanical strength and having thick walls and intricate features may be formed. Wall thicknesses or feature diameters may range from 1 mm to 10 mm, or greater.

While FIG. 1B illustrates one example of two hemispherical shells that may be connected together at thermoplastically formed attachment portions, numerous other complex shapes of articles with complicated structural features may be formed using the approaches described herein. It will be appreciated that the exemplary bulk metallic glass castings 122 illustrated in the example of FIG. 1A are of a more complicated shape that ordinary solid sheet, solid bar, or solid rod, whether or rectangular or cylindrical cross section (cylindrical includes curved shapes other than perfect circles in cross section). And similarly, the cavity 119 of mold 112, 114 is likewise of a more complicated shape than that for casting ordinary solid sheet, solid bar, or solid rod, whether or rectangular or cylindrical cross section. Exemplary aspects of providing complex near net shapes of castings using cavities of complex shape are described with reference to the examples of FIGS. 1C-1E. FIG. 1C illustrates an exemplary BMG casting 122 on a three-dimensional coordinate system with axes labeled x, y and z. It will be appreciated that the mold 112, 114 could likewise be aligned with the coordinate system, and reference to such will likewise be discussed below. The exemplary BMG casting 122 is in the shape of a hollow hemisphere having a Radius R and wall thickness t1 normal to the radial direction. FIG.

1D shows exemplary two-dimensional cross sections of casting 122 in planes parallel to the y-z plane at various values of x, namely x=0, x=R/2 and x=7R/8. As shown in FIG. 1D, multiple two-dimensional cross sections of the bulk metallic glass casting 122 are different from one another in multiple mathematical planes intersecting the casting displaced from one another in the x-direction normal to the mathematical planes intersecting the casting 122. Indeed, the cross section for plane intersecting at x=R/2 is characterized by a wider apparent wall thickness t2 and an overall smaller expanse compared to the cross section for the plane at x=0 with wall thickness t1 because of the how the plane intersects the curvature of the casting 122. The cross section for the plane at x=7R/8 is further different from the other illustrated cross sections and does not intersect a hollow portion of the casting 112 whatsoever. Similarly, as shown at aspect 110 of FIG. 1A, the cavity 119 of mold 112, 114, likewise possesses such complexity. Namely, with mold 112, 114 aligned to the three-dimensional coordinate system of FIG. 1C, and by analogy with FIG. 1D, it can be seen that the mold 112, 114 is configured such that multiple two-dimensional cross sections of the cavity 119 of the mold are different from one another in multiple first mathematical planes intersecting the cavity displaced from one another in a first direction (e.g., the x-direction) normal to the mathematical planes intersecting the cavity.

Similarly, FIG. 1E shows exemplary two-dimensional cross sections of casting 122 in planes parallel to the x-z plane at various values of y, namely y=0, y=R/2 and y=7R/8. As shown in FIG. 1E, multiple two-dimensional cross sections of the bulk metallic glass casting 122 are different from one another in multiple mathematical planes intersecting the casting displaced from one another in the y-direction normal to the mathematical planes intersecting the casting 122. Indeed, the cross section for plane intersecting at y=R/2 is characterized by a wider apparent wall thickness t2 and an overall smaller expanse compared to the cross section for the plane at y=0 with wall thickness t1 because of the how the plane intersects the curvature of the casting 122. The cross section for the plane at x=7R/8 is further different from the other illustrated cross sections and does not intersect a hollow portion of the casting 112 whatsoever. Similarly, as shown at aspect 110 of FIG. 1A, the cavity 119 of mold 112, 114, likewise possesses such complexity. Namely, with mold 112, 114 aligned to the three-dimensional coordinate system of FIG. 1C, and by analogy with FIG. 1E, it can be seen that the mold 112, 114 is configured such that multiple two-dimensional cross sections of the cavity 119 of the mold are different from one another in multiple second mathematical planes intersecting the cavity displaced from one another in a second direction (e.g., the y-direction) normal to the second mathematical planes intersecting the cavity.

Similarly, FIG. 1F shows exemplary two-dimensional cross sections of casting 122 in planes parallel to the x-y plane at various values of z, namely z=R, z=R/2 and z=R/8. As shown in FIG. 1F, multiple two-dimensional cross sections of the bulk metallic glass casting 122 are different from one another in multiple mathematical planes intersecting the casting displaced from one another in the z-direction normal to the mathematical planes intersecting the casting 122. Indeed, the cross section for plane intersecting at z=R/2 is characterized by a wider apparent wall thickness t2 and an overall smaller expanse compared to the cross section for the plane at z=R because of the how the plane intersects the curvature of the casting 122. The cross section for the plane at z=R/8 is further different and smaller from the other illustrated cross sections and does not intersect a hollow portion of the casting 112 whatsoever. Similarly, as shown at aspect 110 of FIG. 1A, the cavity 119 of mold 112, 114, likewise possesses such complexity. Namely, with mold 112, 114 aligned to the three-dimensional coordinate system of FIG. 1C, and by analogy with FIG. 1F, it can be seen that the mold 112, 114 is configured such that multiple two-dimensional cross sections of the cavity 119 of the mold are different from one another in multiple third mathematical planes intersecting the cavity displaced from one another in a third direction (e.g., the z-direction) normal to the third mathematical planes intersecting the cavity.

According to examples such as explained above, it will be appreciated that the mold 112, 114 comprises a cavity 119 with a three dimensional shape for making a casting from the molten alloy, wherein the three dimensional shape of the cavity may not have a substantially uniform cross section in multiple mathematical planes displaced from one another in a first direction, e.g., the x-direction. In examples, the mold can be configured so that the cavity (e.g., cavity 119) may not have a substantially uniform cross section in multiple mathematical planes displaced from one another in each of first, second and third directions, e.g., the x-direction, the y-direction and the z-direction. Similarly, in examples, the near net shape of BMG casting is not in the shape of a solid sheet, solid bar or solid cylinder that have substantially uniform two-dimensional cross sections. Rather, both the cavity(s) of the mold(s), and the resulting BMG castings can have shapes that are substantially more complicated than ordinary solid sheet, bar or rod. Also, it will be appreciated that the descriptions of complexity with regard to castings and cavity shapes of the molds pertain to the primary shapes of the desired end-result castings and primary shapes of the cavities, above and beyond (i.e., does not include) the shapes of any sprues and feeder paths that may feed molten alloy to such primary cavities. In other words, the exemplary articles themselves have complexity in shape such as described above have irrespective of any casting artifacts associated with sprues and feeder tubes, and such artifacts can be removed as part of a suitable intermediate process, e.g., prior to thermoplastic forming, or as a part of a suitable finishing process, e.g., cleaning, polishing, etc.

It will be appreciated that if the exemplary articles illustrated in FIGS. 1A and 1B were desired to be made solely by die casting, without thermoplastic forming, it is possible that excessive turbulence of the melt could occur, potentially resulting in undesirable properties of the final product. Also, with the use of only die casting, significant heat loads on the tooling would occur, potentially reducing tooling life. Moreover, gravity casting alone would not be able to produce a part with the final shape features desired. Further, an attempt to form the exemplary BMG articles illustrated in FIGS. 1A and 1B via thermoplastic forming starting from a square or rectangular BMG plate would require extensive deformation, possible folding and buckling, loss of material during forming, and potentially too great of a processing time. As described herein, casting, e.g., gravity casting with permanent molds, of a near net shape amorphous blank that can be subsequently thermoplastically formed (TPF) can reduce flow distance of material during the thermoplastic forming step, reduce the amount of material required, and allow for final net shape features impossible with gravity casting alone. Thus, it will be appreciated that a combination of casting and subsequent thermoplastic forming as described herein can provide advantages over conventional processing techniques.

FIG. 2 shows an exemplary apparatus and approach for generating the melt of desired composition used for casting the BMG casting or blank using a heating apparatus 200 that may be capable of providing both a vacuum environment as well as an overpressure environment. In this example, the apparatus 200 comprises a vacuum chamber 212, a crucible 230 with heating element(s) 232. A vacuum valve 222 connected to a port of the vacuum chamber 212 is connected to a vacuum system to evacuate the chamber 212 and maintain a desired level of pressure/vacuum in the chamber 212. A valve 224 is connected to a port on the vacuum chamber 212 to permit gas, e.g., inert gas such as argon, helium, nitrogen, etc., to be fed into the chamber 212 to maintain a desired gaseous environment in the chamber 212 at a desired pressure, including an overpressure, as well as to purge the chamber of contaminants through alternating evacuation and back filling with inert gas. One or more pressure sensors 226 may be provided for measuring the pressure in the vacuum chamber 212. Any suitable combination of gas flow controllers, pressure sensors, vacuum pumps and associated vacuum plumbing may be utilized to control the vacuum/pressure conditions and gaseous environment of the vacuum chamber 212, e.g., in the range of one bar to several bars or more, (e.g., about 2, 3, 4 or 5 bars, 6-10 bars, or more) wherein one bar is atmospheric pressure (760 Torr), to sub-ambient pressures less than atmospheric pressure (e.g., a few hundred Torr to $10^{-6}$ Torr), including low vacuums (e.g., $10^{-2}$-$10^{-6}$ Torr, for instance). One or more temperature sensors 234 (e.g., thermocouples) for measuring the temperature of one or more locations of the crucible 130 may be provided, e.g., to monitor the temperature of the crucible 230.

As shown in FIG. 2, multiple constituents 202, 204, 206, 208, etc., can be placed into a container, e.g., crucible 230. These constituents may include, for instance, Pt, Ni, Cu, Ti, Zr, Nb, Be, or any other desired constituents, including any volatile constituents such as P, for example, to form whatever alloy chemistry is desired. While a crucible 230 is shown as the exemplary container in FIG. 2, the container could be a quartz tube fused at one end and equipped with a suitable compression fitting connected to suitable vacuum/gas plumbing to evacuate the tube and control the gaseous environment in the tube. The container, e.g., crucible 230 may be heated by an induction heating coil 232, or by any other suitable means of heating, to promote alloying and melting of the constituents. Also, some of all of the constituents may already be in the form of other alloys themselves. Heating and melting may be carried out in an inert atmosphere at a pressure of less than, equal to, or greater than 1 bar. If volatile species are present, a positive pressure, e.g., of several bars or more, e.g., of Argon, or other inert gas, may be used in the chamber to reduce to at least some extent the sublimation of any volatile species of the constituents being melted.

Thereafter, during the same process or during a subsequent process, the melt may cast into a desired mold as discussed above with respect to FIG. 1A, e.g., using gravity casting into a permanent mold, die casting, or counter gravity casting. For example, counter gravity casting could be used such as disclosed in copending U.S. patent application Ser. No. 13/840,445 filed Mar. 15, 2013, the entire contents of which are incorporated herein by reference. The cooling during the casting step can be done at a sufficient cooling rate so that the casting or blank is a BMG material, i.e., has an amorphous structure. For instance, BMG blanks or castings may be cast with substantial features having diameters on the order of 1 mm to 10 mm or larger (e.g., between 1 mm and 5 mm, between 5 mm and 10 mm, between 10 mm and 20 mm, greater than 20 mm, etc.) directly from the melt at relatively slow critical cooling rates depending upon the particular BMG composition. The thermoplastic forming process may also be carried out in a chamber such as illustrated in FIG. 2 so as to carry out that process under a controlled atmosphere, e.g., an inert atmosphere, such as in Argon gas. Alternatively, in another example, the thermoplastic forming may be carried out in air for BMG compositions where exposure to air at temperatures above Tg will not be detrimental to the BMG article or the processing.

A flow diagram for an exemplary approach for casting and thermoplastically forming a BMG casting into a final BMG article of desired shape illustrated in the flow diagram of FIG. 3. At step 302, multiple constituents for forming the melt are placed in the container e.g. a crucible. At step 304, the multiple constituents are heated to a temperature sufficient for alloying and melting the constituents, e.g., under an inert atmosphere such as argon, e.g., at a pressure below at or above one bar. At step 306, the melt is cast into one or more molds using, e.g., gravity casting into a permanent mold, counter-gravity casting, die casting, or other casting method, and the melt is cooled at a sufficient cooling rate to provide castings of a first shape or shapes, e.g., near net shape BMG castings (also called blanks). The melt can be fed into one mold or multiple molds in this regard. At step 308, the castings are removed from the molds, and the process may be repeated for as many castings as desired. At step 310, the castings are placed in proximity to thermoplastic forming members, or forms, for thermoplastic forming. At step 312, the castings are thermoplastically formed at an elevated temperature, e.g., $T>Tg$ and $T<Tx$ (where Tx is the crystallization temperature of the BMG), to form BMG articles with desired final shapes and structural features. At step 314, the final BMG articles are removed, and thermoplastic forming and removal can be repeated for as many BMG articles as desired BMG articles of various desired compositions can be formed using the approaches described herein. Such BMGs can include, for example, Zirconium-based BMGs, Titanium-based BMGs, Beryllium containing BMGs, Magnesium-based BMGs, Nickel-based BMGs, Al-based BMGs, and Pt or Pd based BMGs to name a few. Examples include alloys known by trade names VITRELOY 1, VITRELOY 1b, VITRELOY 4, VITRELOY 105, VITRELOY 106, and VITRELOY 106A. Further examples include Zr—Ti—Cu—Ni—Be BMGs, such as described in U.S. Pat. No. 5,288,344, Zr—Cu—Al—Ni BMGs, and Zr—Cu—Al—Ni—Nb BMGs, such as described in U.S. Pat. Nos. 6,592,689 and 7,070,665. Other examples also include Zr—(Ni, Cu, Fe, Co, Mn)—Al BMGs, such as described in U.S. Pat. No. 5,032,196, and alloys described in U.S. Patent Application Publication No. 20110163509. Other Zr based BMG alloys include those disclosed in the following patent documents: U.S. Pat. Nos. 8,333,850, 8,308,877, 8,221,561, 8,034,200, 7,591,910, 7,368,023, 7,300,529, 7,153,376, 7,070,665, 6,896,750, 6,805,758, 6,692,590, 6,682,611, 6,592,689, 6,521,058, 6,231,697, 5,735,975; U.S. Patent Application Publication Nos. 20120305142, 20120298264, 2012022278, 20120073706, 20110308671, 20110100514, 20110097237, 20090202386, 20090139612, 20080190521; and International Patent Application Publication No. WO2011159596.

In other examples, the metallic alloy may be an allow of Pt, Pd, Cu, Ni, and P, e.g., with a composition given by $(Pt,Pd)_x(Cu,Ni)_yP_z$ wherein x ranges from about 20 to 60 atomic percent, y ranges from 15 to 60 atomic percent, and z ranges from about 16 to 24 atomic percent. In another example, the constituents may include Ni, Cr, Nb, P and B. In one example, the alloy may have a composition given by $Ni_{69}Cr_{8.5}Nb_{3.0}P_{16.5}B_{3.0}$.

In another example, the metallic alloy may have a composition given by $((Pt,Pd)_{1-x}TM_{1x})_a((Cu,Co,Ni)_{1-y}TM_{2y})_b((P,Si)_{1-z}S_{Mz})_c$, wherein a ranges from about 20 to 65 atomic percent, b ranges from about 15 to 60 atomic percent, c ranges from about 16 to 24 atomic percent; wherein the concentration of Pt is at least 10 atomic percent; wherein the concentration of Co is non-zero and the total concentration of Ni and Co in combination is at least 2 atomic percent; wherein the concentration of P is at least 10 atomic percent; wherein TM1 is selected from the group consisting of Ir, Os, Au, W, Ru, Rh, Ta, Nb and Mo; wherein TM2 is selected from the group consisting of Fe, Zn, Ag, Mn and V; wherein SM is selected from the group consisting of B, Al, Ga, Ge, Sn, Sb, and As, wherein x, y and z are atomic fractions such that z is less than about 0.3 and the sum of x, y and z is less than about 0.5, such that when a is less than 35, x is less than about 0.3 and y is less than about 0.1, when a is in the range of from about 35 to 50, x is less than about 0.2 and y is less than about 0.2, and when a is more than 50, x is less than about 0.1 and y is less than about 0.3. The compositions are not limited to those described above, and other compositions of BMGs may be processed according to the approaches described herein.

In any of the above-described approaches, the melt of the metallic alloy may be fluxed with boron oxide to enhance the glass forming ability of the alloy, but this is optional and not necessary.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps. It should also be understood that as used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise. Finally, as used in the description herein and throughout the claims that follow, the meanings of "and" and "or" include both the conjunctive and disjunctive and may be used interchangeably unless the context expressly dictates otherwise.

While the present invention has been described in terms of exemplary embodiments, it will be understood by those skilled in the art that various modifications can be made thereto without departing from the scope of the invention as set forth in the claims.

What is claimed is:

1. A method for casting and thermoplastically forming a bulk metallic glass article, comprising:

feeding a molten alloy into a mold, wherein the mold comprises a cavity with a three-dimensional shape for casting the molten alloy, the mold being configured such that multiple two-dimensional cross sections of the cavity of the mold are different from one another in multiple first mathematical planes intersecting the cavity displaced from one another in a first direction normal to the mathematical planes intersecting the cavity, cooling the molten alloy in the mold to provide a near-net-shape bulk metallic glass casting in the mold;

removing the near-net-shape bulk metallic glass casting from the mold, wherein multiple two-dimensional cross sections of the bulk metallic glass casting are different from one another in multiple mathematical planes intersecting the casting displaced from one another in a given direction normal to the mathematical planes intersecting the casting; and thermoplastically forming the near-net-shape bulk metallic glass casting at an elevated temperature above a glass transition temperature of the near-net-shape bulk metallic glass casting to provide a bulk metallic glass article with a desired final shape.

2. The method of claim 1, wherein the mold is configured such that multiple two-dimensional cross sections of the cavity of the mold are different from one another in multiple second mathematical planes intersecting the cavity displaced from one another in a second direction normal to the second mathematical planes, wherein the second direction is different from the first direction.

3. The method of claim 2, wherein the mold is configured such that multiple two-dimensional cross sections of the cavity of the mold are different from one another in multiple third mathematical planes intersecting the cavity displaced from one another in a third direction normal to the third mathematical planes, wherein the third direction is different from the first direction and the second direction.

4. The method of claim 1, wherein multiple two-dimensional cross sections of the near-net-shape bulk metallic glass casting are different from one another in multiple mathematical planes intersecting the casting displaced from one another in another direction normal to the mathematical planes intersecting the near-net-shape bulk metallic glass casting, wherein said another direction is different from said given direction.

5. The method of claim 1, wherein the near-net-shape bulk metallic glass casting comprises a hollow portion.

6. The method of claim 1, wherein the bulk metallic glass article comprises a thickness dimension of bulk metallic glass alloy in the range of 1 mm to 10 mm.

7. The method of claim 1, comprising making multiple near-net-shape bulk metallic glass castings.

8. The method of claim 7, wherein the multiple near-net-shape bulk metallic glass castings comprise hollow hemispheres.

9. The method of claim 8, comprising thermoplastically forming the hollow hemispheres to provide connecting features that permit a first hollow hemisphere and a second hollow hemisphere to be attached to one another.

10. The method of claim 1, wherein the bulk metallic glass article is hollow.

11. The method of claim 1, wherein the near-net-shape bulk metallic glass casting is hollow.

* * * * *